United States Patent [19]

Roos et al.

[11] Patent Number: 4,557,818

[45] Date of Patent: Dec. 10, 1985

[54] GAS-EVOLVING METAL ELECTRODE

[75] Inventors: Hans Roos, Bad Durkheim; Dieter Schlaefer; Hugo Boehn, both of Ludwigshafen; Knut Bittler, Speyer; Heinz Kilthau, Ludwigshafen, all of Fed. Rep. of Germany

[73] Assignee: BASF Aktiengesellschaft, Fed. Rep. of Germany

[21] Appl. No.: 630,184

[22] Filed: Jul. 12, 1984

[30] Foreign Application Priority Data

Jul. 13, 1983 [DE] Fed. Rep. of Germany ..... 3325187
Dec. 16, 1983 [DE] Fed. Rep. of Germany ..... 3345530

[51] Int. Cl.[4] ..... C25B 11/02
[52] U.S. Cl. ..... 204/288; 204/289
[58] Field of Search ..... 204/284, 286, 288, 289, 204/219–220, 250, 278

[56] References Cited

U.S. PATENT DOCUMENTS 3,409,533 11/1968 Murayama et al. ..... 204/219
3,671,415 6/1972 King et al. ..... 204/284
3,795,603 3/1974 Glos et al. ..... 204/219
4,033,847 7/1977 Baker ..... 204/250
4,059,500 11/1977 Kamarian ..... 204/289
4,379,742 4/1983 Rathjen et al. ..... 204/286

FOREIGN PATENT DOCUMENTS 7207894 3/1972 Fed. Rep. of Germany .
2721958 11/1978 Fed. Rep. of Germany .
1231280 5/1971 United Kingdom .
1235570 6/1971 United Kingdom .
1273485 5/1972 United Kingdom .

*Primary Examiner*—Donald R. Valentine
*Attorney, Agent, or Firm*—Keil & Weinkauf

[57] ABSTRACT

A gas-evolving metal electrode consists of profiles which are arranged parallel to one another in a horizontal plane and are connected to one another by means of current distributors. The profile surfaces which face the counter-electrode are curved, the curvature at the sides being more pronounced than that in the middle. The profile is terminated above by means of two lateral surfaces tangential to the curvature. The electrode is useful as an anode for mercury cells for the chloralkali electrolysis.

4 Claims, 2 Drawing Figures

GAS-EVOLVING METAL ELECTRODE

Figure 1:
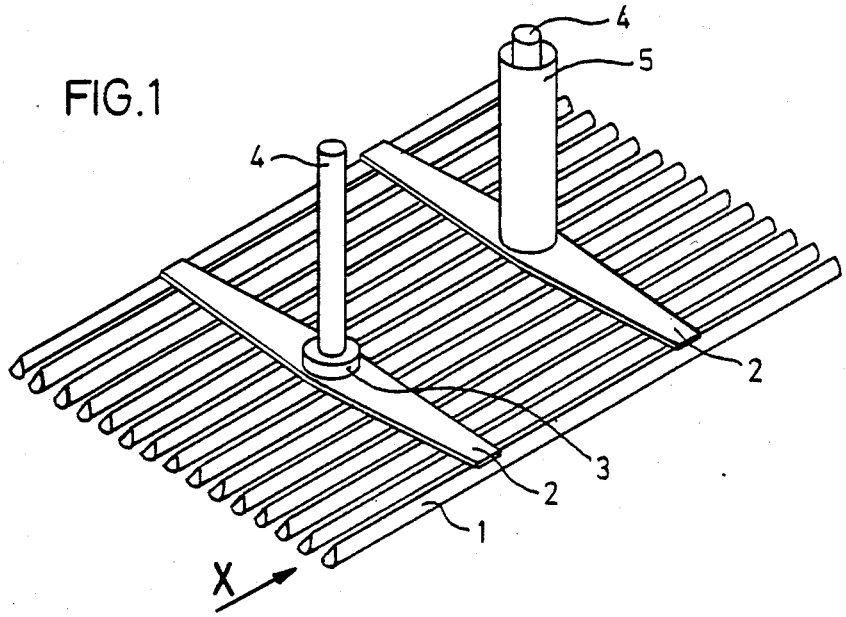

The present invention relates to a gas-evolving metal electrode which is particularly suitable as, for example, an anode in mercury cells for the chloralkali electrolysis.

In the preparation of, for example, chlorine by electrolysis of aqueous alkali metal chloride solutions, titanium anodes which have active layers containing noble metals are generally used today. Compared with the graphite electrodes mainly used before, these dimensionally stable anodes have the advantage that the external dimensions do not change during operation. The disadvantages of these anodes are the relatively high production costs resulting from the high price of the titanium and the expensive procedure required to process it, as well as from the use of noble metals in the active layer.

Compared with graphite, however, the use of titanium as a basic electrode material permits a large number of different geometrical structures, so that the electrode can fulfil its required function as a gas-producing electrode. In particular, it has become possible to produce very flat electrode surfaces ($\pm 1$ mm difference/$m^2$ of electrode area). This in turn enables the distance between anode and cathode to be reduced substantially. Since the electrolyte solution, ie. the NaCl solution in the case of the chloralkali electrolysis, has an electrical resistance, it is desirable to reduce to a minimum the consequent voltage or energy losses by maintaining a very small distance between the electrodes.

At the same time, however, it is necessary to provide a certain minimum distance for carrying out the electrolysis reaction and also for ensuring that, as far as possible, no short circuits can take place.

German Published Application DAS No. 2,041,250 describes an electrode design in which the working electrode surface opposite the cathode, for example the mercury cathode in the production of chlorine by the mercury process, is made of expanded metal, perforated sheet, wire mesh or the like. Uniform current distribution is achieved by means of a U-shaped conductor rail, which also has to provide the expanded metal with the necessary rigidity in order to achieve the required planarity. It can easily be seen that the production of such a conductor rail is very difficult, since it has to be produced by pressing titanium sheets to give U-shaped components, and titanium tends to spring back readily after such a pressing process. Moreover, it is necessary to incorporate notches into this conductor rail, the notches reducing the stresses which result when the expanded metal is welded to the rail. They are also intended to permit subsequent correction of the working surface of the anode in order to achieve better planarity of this surface. Another disadvantage is that large amounts of titanium are used for constructing the conductor rail. During the electrolysis reaction, the gas bubbles formed are passed upward through the openings in the expanded metal, perforated sheet, etc. Hence, for further removal of gas, openings also have to be provided in the conductor rail, which has a relatively large surface area. Where the areas of the electrodes are relatively large, it is also necessary to fix the individual conductor rails additionally by means of stable cross bracing.

In the design described in German Laid-Open application DOS No. 1,814,567, easy escape of the gas bubbles is said to be provided by an expensive system consisting of primary and secondary conductor rails, and this system is also intended to provide the working electrode surface with the necessary strength (and hence planarity). This solution entails high material and production costs, especially since a large number of welding operations are required and the individual components have to be adjusted exactly.

A similar design is described in German Laid-Open application DOS No. 2,043,560. Here, the electrode surface consists of a perforated titanium structure which extends essentially horizontally, and the strength of the electrode surface is increased by means of round rods which are arranged at intervals, parallel to the structure, and which also ensure the distribution of current. These round rods are connected by means of rectangular rails which are arranged at right angles to them and which are used to supply current. The core of these rods and rails consists of aluminum, which in turn is surrounded by titanium. This anode structure, too, requires an expensive production process. Moreover, the titanium jacket around the aluminum must be absolutely tight at all points, particularly at the weld seams, since the slightest damage to the titanium jacket results in rapid destruction of the electrode due to anodic dissolution of the aluminum, which takes place in the presence of chloride.

German Laid-Open application DOS No. 2,721,958 describes a similar design, in which, in order to improve the conduction of current and to save expensive titanium, essential parts of the electrode consist of titanium components whose core is filled with rods which are made of other metals and which are embedded in an electrically conductive material which is predominantly fluid under the operating temperature.

In German Laid-Open application DOS No. 2,323,497, easy escape of the gas is achieved by means of vertical titanium webs which have a rectangular cross-section and are connected together at a certain distance apart so that the gas bubbles can escape through the resulting gaps. A further requirement is that these webs also be activated at the sides, so that evolution of chlorine can take place there too. This is intended to increase the effective electrode surface, since the horizontal web sections opposite the Hg cathode have only a small surface area compared with the geometrical surface of the entire electrode. However, as recent investigations have shown (Chem. Ing. Techn. 52 (1980), 48–51), it is certain that these lateral surfaces cannot make any relevant contributions to the evolution of chlorine because of their relatively large distance from the counter-electrode. Moreover, the electrically insulating gas bubbles evolved at the horizontal surface have to pass these intermediate spaces, which furthermore hinders the flow of current in this area.

U.S. Pat. No. 4,033,847 describes a complicated structure for providing the electrode surface with the necessary strength and for achieving good current distribution. It consists of a spider-like current distribution system, in which additional supporting ribs are required. As stated in the patent, in order to produce the corresponding structures it is necessary to employ fusion and casting processes. However, it is well known that these processes are complicated and expensive when used for processing metals, in particular titanium or valve metals, since, for metallurgical reasons, valve metals can only be melted in an argon atmosphere in the strict absence of air. Another possible solution is described in German Laid-Open application DOS No. 2,949,495. However, this design likewise requires a primary and secondary current distribution system which, similarly to that described in German Laid-Open application DOS No. 1,814,567, entails high production and material costs. The relatively open construction of this system consisting of flat profiles is intended to improve detachment of the gas bubbles and material transfer at the electrode surface.

German Laid-Open application DOS No. 3,008,116 describes an electrode design which possesses only a primary distributor system but is likewise relatively expensive. The oval profiles used in this case are formed by flattening the round rods. This is intended to achieve a ratio of working electrode surface to projected electrode surfaces of $\geqq 1$. However, no account is taken here (cf. J. Cramer, Chem. Ing. Techn. 52, (1980), 48–51) of the fact that the solution being electrolyzed offers a resistance to the passage of the electrical current, so that the further away the electrode surfaces are from the counter-electrode, the less they contribute to the electrolysis reaction, ie. to gas evolution. The simple reason for this is that the current paths follow the shortest possible way through the solution being electrolyzed. This state of affairs can be further illustrated as follows: in this design, the pronounced curvature does of course result in the gas bubbles being removed from the working electrode surface more rapidly than in the case of the flat profiles used in German Laid-Open application DOS No. 2,949,495, but these relatively small radii of curvature have the disadvantage that, during the electrolysis, there are very high current densities in the regions closest to the cathode. This results in higher evolution potentials and therefore also a higher cell voltage or energy consumption. The regions further away from the cathode are at a disadvantage because of the thicker electrolyte layer with a correspondingly higher electrical resistance. This, too, has a disadvantageous effect on the cell voltage.

Finally, German Utility Model No. 7,207,894 describes a gas-evolving electrode which consists of a plate which is penetrated by channels which are widened in the direction of one surface of the electrode and close to this surface. These channels can be of entirely conical or venturi-like design. This is intended to achieve improved electrolyte circulation. This electrode is expensive to manufacture and is not used industrially since it is sheet-like electrodes in particular which have fundamental disadvantages with regard to removal of gas.

It is an object of the present invention to provide a form for a gas-evolving metal electrode which should possess the following characteristics:

very small amount of material required for the production of the electrode element.

Simple design but good mechanical strength coupled with ease of repair and good planarity of the electrode surface.

As far as possible, the electrode profiles should not have any edges, since increased wear of the active layer takes place at these points.

It is intended to improve the detachment of gas bubbles by means of novel profile cross-sections designed from a hydrodynamical point of view. Since gas bubbles act as insulators with respect to the passage of current, their rapid removal serves to reduce the energy requirement for the electrolysis.

The distribution of the current paths on the working electrode surface should be very uniform.

We have found that this object is achieved by a gas-evolving metal electrode for electrolysis cells, in particular an anode for mercury cells for chloralkali electrolysis, which consists of profiles arranged parallel to one another in a horizontal plane, where the effective electrode surface facing the counter-electrode is curved and the profiles are connected to one another by means of current distributors which are at right angles to the profiles and provided with a current supply, wherein the curvature of the effective electrode surface changes, in the region of the gaps, to a curvature with a smaller radius (r), the radius (R) which determines the curvature of the effective electrode surface being from 7 to 180 mm and the smaller radius (r) being from 0.5 to 4 mm, and the profiles are terminated above by means of two lateral surfaces (22, 23) which are tangential to the curvature and enclose an angle (alpha) of from 20° to 120° at their point of intersection.

In the electrodes according to the invention, the profiles used can be solid or hollow profiles. Although the use of solid profiles requires more titanium than that of hollow profiles, this disadvantage must be set against the advantage of reduced resistance and a smaller voltage drop. Moreover, solid profiles are easier to process.

Furthermore, in accordance with the invention, the effective electrode surface, ie. the surface which can be projected onto the counter-electrode, is curved in such a way that the curvature increases from the middle to the edges.

With regard to the curvature of the middle part, two opposing requirements have to be met, ie.

(1) on the one hand, the working surface should be very flat and thereby ensure a constant distance between the anode surface and the counter-electrode, this being advantageous with regard to uniform current density distribution but disadvantageous in terms of the required removal of gas bubbles; and (2) on the other hand the working surface should be highly curved, in which case the above advantages become disadvantages, and vice versa.

The novel gas-evolving metal electrode is illustrated below with reference to FIG. 1, which is a perspective view, and FIG. 2, which shows two profiles in magnified form and viewed along direction X.

The effective electrode surface consists of profiles arranged parallel to one another. These electrode profiles are connected together mechanically and electrically by welding them to one or more titanium webs (2) which possess a shape specially developed for the purpose described. Titanium elements (3) possessing an inner thread are mounted on these webs. The inner thread can be used to connect a current supply (4), eg. a copper pin. If required, this pin can be protected from the electrolyte solution (and hence from anodic dissolution) by means of a titanium tube (5) which is welded on. The current supply to the individual electrode profiles is exclusively through a simple primary conductor system comprising titanium webs (2). This can easily be produced from commercial titanium sheets of appropriate thickness (adapted to the current load) by a simple punching procedure. As the distance from the point of contact of this conductor system increases, the amount of current which has to be transported to the electrode profiles decreases steadily since the number of profiles still to be supplied is smaller; hence, the conductive cross-section of this component also becomes smaller.

In FIG. 1, this can be seen from the fact that the width of the titanium web (2) decreases. This also helps to minimize material costs.

Figure 2:
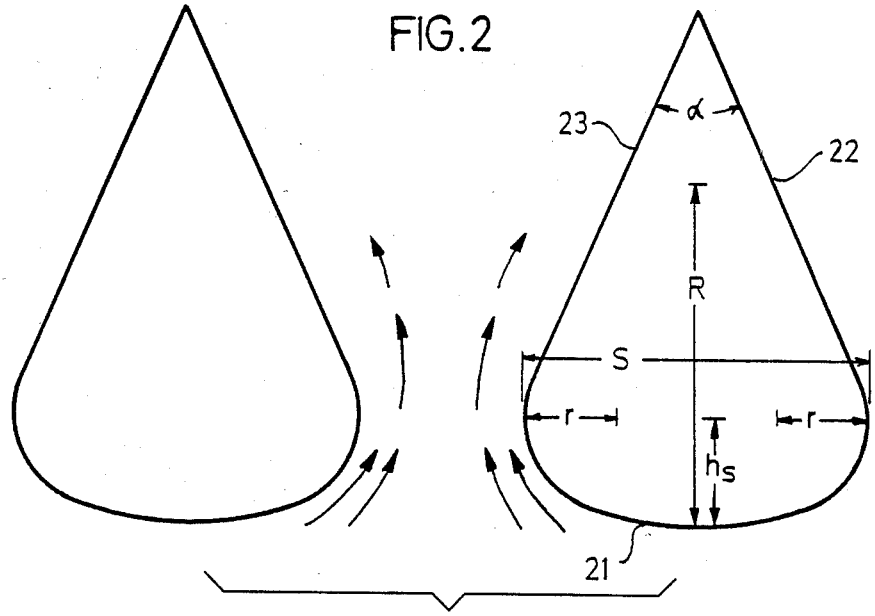

FIG. 2 shows diagrammatically two novel hollow electrode profiles which are magnified compared with FIG. 1 and which lie next to each other as seen along direction X in FIG. 1.

The working surface 21, ie. the surface which can be projected onto the counter-electrode, is curved, in accordance with the invention, so that the curvature at the sides, ie. toward the adjacent profile or toward the cell wall, becomes more pronounced. The curvature is determined by the radius R and the two smaller radii r. The hollow profile is terminated above by means of the two intersecting lateral surfaces 22 and 23, which are tangential to the curved working surface.

Thus, the cross-section of the gap between two profiles has the profile of a jet-like rounded inlet zone and a calming zone widening upward like a diffusor. The slight curvature causes the gas bubbles formed at the working surface to move toward the edges of the profiles where the increasing curvature gives these bubbles the desired steady acceleration, in contrast to abrupt detachment of the gas bubbles at an edge-like profile, which entails a higher pressure loss. As a result, the gas is brought, with a minimum pressure loss, to the velocity required for passing the narrowest point of the gap between two profiles. As a result of the smaller pressure loss, the gas bubbles reach a higher velocity, and a larger amount of liquid is consequently entrained. This leads to an improved exchange of the electrolyte solution in front of the working surface. Immediately after the narrowest point, the gas flows into the widening calming zone, which opens at an angle such that the gas bubbles reach their normal rising velocity substantially without pressure loss.

The above effects which promote the removal of gas furthermore permit profile designs with relatively great web widths S of from 6 to 30 mm, whereas the web widths in some of the conventional designs are substantially below 6 mm. The advantage of using a wide profile is obvious: for given cell dimensions, a smaller number of profiles is required.

In order that the effects described above can be fully realized, the profiles should have certain geometrical dimensions, the choice of which depends on the cell conditions.

As stated above, the working surface has a smaller curvature in the middle than at the edges. For example, the curvature of the middle part is determined by a circle whose radius R is 7–180 mm, preferably 15–25 mm, whereas at the two sides the curvature becomes more pronounced and changes to a circle with a radius r of from 0.5 to 4 mm. The two radii should be chosen so that $R/r \geqq 5$.

In the novel embodiment of the working surface, the relatively large radius of the circle in the middle region ensures a virtually optimum constant distance between the working surface and the cathode, but the relatively small curvature of this middle region is sufficient to ensure that the gas bubbles formed are transported away rapidly. The more pronounced curvature where the working surface meets the tangential lateral surfaces avoids edges at this point, edges being known to suffer greater wear.

The height of the arc (ie. the greatest distance between the web width S and the working surface 21) depends on the radius R of the middle circle and the web width S; however, this height should satisfy the condition that $R/h_s$ is from 5 to 1800.

The slope of the lateral surfaces can likewise be varied within wide limits. This slope is determined by the angle at which they meet, which can advantageously be from 20° to 120°.

The production of the novel metal electrodes, which are useful in particular as anodes for the chloralkali electrolysis, is not very technically complicated. For their production, it is necessary only for the individual electrode profiles (1) to be welded continuously with the distributor webs (2). To ensure better attachment, these webs can contain notches into which the profiles are introduced. The relatively long weld seam ensures good passage of current from the distributor web to the profiles.

Although the novel electrode design possesses an extremely simple structure, it has excellent mechanical strength, essentially resulting, inter alia, from the cross-sectional shape of the novel profiles. Consequently, the electrodes are also very easy to repair. When a profile is damaged, for example as a result of a short circuit, the particular electrode profiles can easily be replaced individually, or can be brought to the required planarity by an appropriate adjustment procedure.

The extremely small wear of the electrodes due to the lack of edges has been mentioned above.

Because of the rapid removal of gas bubbles described above, it is possible to design profiles with effective widths unknown to date. In other words, the ratio of effective electrode surface, in which there is a substantially uniform distribution of current density, to the geometrical electrode surface can consequently be improved substantially.

From the description of the claimed electrode, it furthermore follows that only the actual effective surface of the basic electrode element need be provided with an active layer, since the present design is one in which various sections of the profiles are each optimized in respect of the object to be achieved. For example, the side opposite the counter-electrode is designed so that the working electrode surface can perform its function optimally in the electrolysis process. The other sections of the electrode profile are optimized on the basis of hydrodynamic criteria so as to enable simple production. The design is therefore very suitable for a procedure in which the activating solution is applied by dipping, roller-coating or painting. Since it is relatively simple to coat only the working electrode surface (which is desirable but not a precondition), the required amount of activating solution is reduced to a minimum. This is particularly advantageous where the activating solutions used contain expensive noble metals or noble metal compounds, for example in the case of the conventional $RuO_2$-containing active layers for the anodic evolution of chlorine.

This structure can also be coated very readily by means of spray methods, in particular thermal spray methods, since the working electrode surface does not have any sharp edges and there are no poorly accessible lateral surfaces to coat.

We claim:

1. A gas-evolving metal anode for mercury cells for cholralkali electrolysis, which consists of profiles arranged parallel to one another in a horizontal plane, where the effective electrode surface facing the counter-electrode of the cells is curved and the profiles are connected to one another by means of current distributors which are at right angles to the profiles and provided with a current supply, wherein the curvature of the effective electrode surface changes, in the region of the gaps between two profiles, to a curvature with a smaller radium (r), the radius (R) which determines the curvature of the effective electrode surface being from 7 to 180 mm and the smaller radium (r) being from 0.5 to 4 mm, and the profiles are terminated above by means of two lateral surfaces which are tangential to the curvature and enclose an angle (alpha) of from 20° to 120° at their point of intersection so that the cross-section of the gap between two profiles through which the gas formed at the effective electrode surface is removed has the profile of a jet-like rounded inlet zone and a calming-zone widening upward like a diffusor.

2. A gas-evolving metal electrode as claimed in claim 1, wherein $R/r \geqq 5$.

3. A gas-evolving metal electrode as claimed in claim 1, wherein the height difference $h_s$ between the point nearest to the counter-electrode and the point farthest from it, which height difference results from the curvature of the working surface, satisfies the condition $R/h_s > 5$ and $< 1800$.

4. A gas-evolving metal electrode as claimed in claim 1, wherein the profiles are solid profiles.

* * * * *